US005310979A

United States Patent [19]

Jung et al.

[11] Patent Number: 5,310,979

[45] Date of Patent: May 10, 1994

[54] MICROWAVE OVENS WITH INFRARED RAYS HEATING UNITS

[75] Inventors: Kyung H. Jung; Sang Y. Lee, both of Kyungki, Rep. of Korea

[73] Assignee: Samsung Electronics Co., Ltd., Suwon City, Rep. of Korea

[21] Appl. No.: 985,276

[22] Filed: Dec. 3, 1992

[30] Foreign Application Priority Data

Dec. 3, 1991 [KR] Rep. of Korea ..... 91-22068

[51] Int. Cl.[5] ..... H05B 6/64

[52] U.S. Cl. ..... 219/680; 219/759; 392/429

[58] Field of Search ..... 219/10.55 B, 10.55 R, 219/10.55 E; 392/429, 407

[56] References Cited

U.S. PATENT DOCUMENTS 2,303,873 12/1942 Anderson ..... 219/429
3,621,200 11/1971 Watts, Jr. ..... 219/377
4,486,639 12/1984 Mittelsteadt ..... 219/10.55 B
4,703,154 10/1987 Ikegami et al. ..... 219/542
4,728,763 3/1988 Bell et al. ..... 219/10.55 B

FOREIGN PATENT DOCUMENTS 53-140153 11/1978 Japan .
55-20164 2/1980 Japan .

*Primary Examiner*—Philip H. Leung
*Attorney, Agent, or Firm*—Burns, Doane, Swecker & Mathis

[57] ABSTRACT

An infrared heating unit for a microwave oven comprises an outer envelope in which an electrical heating coil is mounted. The heating coil comprises a series of loops. A group of loops located in a central section of the coil has a pitch interval greater than that of the loops located in end sections of the coil, whereby less heat is generated by the loops located in the central station.

6 Claims, 2 Drawing Sheets

MICROWAVE OVENS WITH INFRARED RAYS HEATING UNITS

BACKGROUND OF THE INVENTION

The present invention relates to an infrared rays heating unit of a microwave oven, more particularly to an infrared rays heating unit comprised of a heating coil.

The conventional inventions for a microwave oven with an infrared rays heating unit such as disclosed in Japanese Laid-Open Publications No. 55-20164(1980) and No. 53-140153(1978) are mainly concerned with a device which prevents high frequency rays generated from a magnetron from directly radiating the infrared rays heating unit.

As illustrated in FIG. 3, because the loops of the heating coil which is located in the infrared rays heating unit in the above conventional inventions, are generally arranged in a regular and dense pattern, the heating coil is inclined to become broken in a short time period due to the radiant heat generated during the operation of the infrared rays heating unit which becomes concentrated on the middle section of the infrared rays heating unit.

As a method for solving the above problem, several support members which hold the heating coil are installed at regular intervals in the infrared rays heating unit.

But, the disadvantages of such a configuration include the greater production costs and maintenance expenses.

It is an object of the present invention to provide a heating coil for an infrared rays heating unit comprised of a longer pitch interval in the middle section than at both end sections of the heating coil, thereby preventing the heating coil from easily becoming broken due to the concentration of radiant heat that is generated by the infrared rays heating unit and thereby considerably lengthening its service life.

SUMMARY OF THE INVENTION

According to one aspect of the present invention, the infrared rays heating unit installed in the upper part of a microwave oven has a configuration as follows. A heating coil is located in an infrared rays heating lamp envelope which is of a non-conductor substance, both ends of the infrared rays heating unit are sealed by a ceramic insulator, and both ends of the heating coil are joined to outer lead rods which are made of stainless steel and become connected to the electric power source.

The radiant heat radiated from the infrared rays heating unit described above is reflected by both the walls of the closed microwave oven and any foodstuffs therein, and is reflected back to the infrared rays heating unit.

Here, as demonstrated by experiments, the reflected radiant heat has a tendency to concentrate more on the center section of the infrared rays heating unit coil than at either end of the heating unit coil.

Consequently, when the pitch interval of the loops in the heating coil are entirely regular as in the conventional arts, the heating coil is easily broken due to the heat fatigue phenomena which is concentrated at the central section of the coil.

In the present invention created for solving the above problem, the heating value generated by a given unit length at the middle section of the heating coil is less than that generated at either end and a thermal equilibrium over the entire length of the heating coil is accomplished by means of increasing the pitch interval of the middle section more than the pitch interval at either end of the heating coil, namely, by consisting of two tightly wound sections and one loosely wound section.

With such an arrangement and simple configuration of the infrared rays heating unit, the present invention has the advantage that the service life of the heating coil is substantially prolonged and thus production costs and maintenance expenses are lower.

DESCRIPTION OF THE PREFERRED EMBODIMENT

Figure 1:
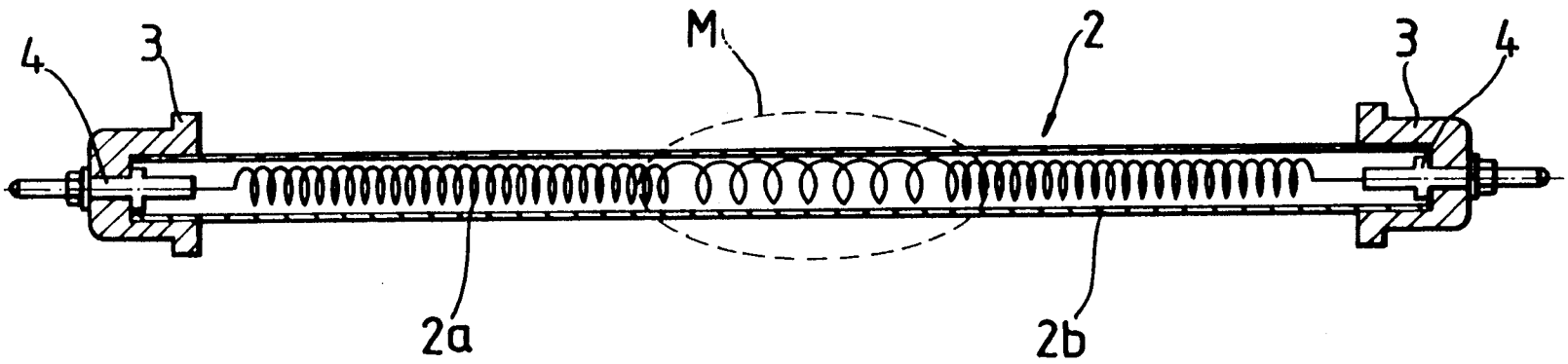
FIG. 1 is a cross-sectional view of the heating coil according to the present invention.
Figure 2:
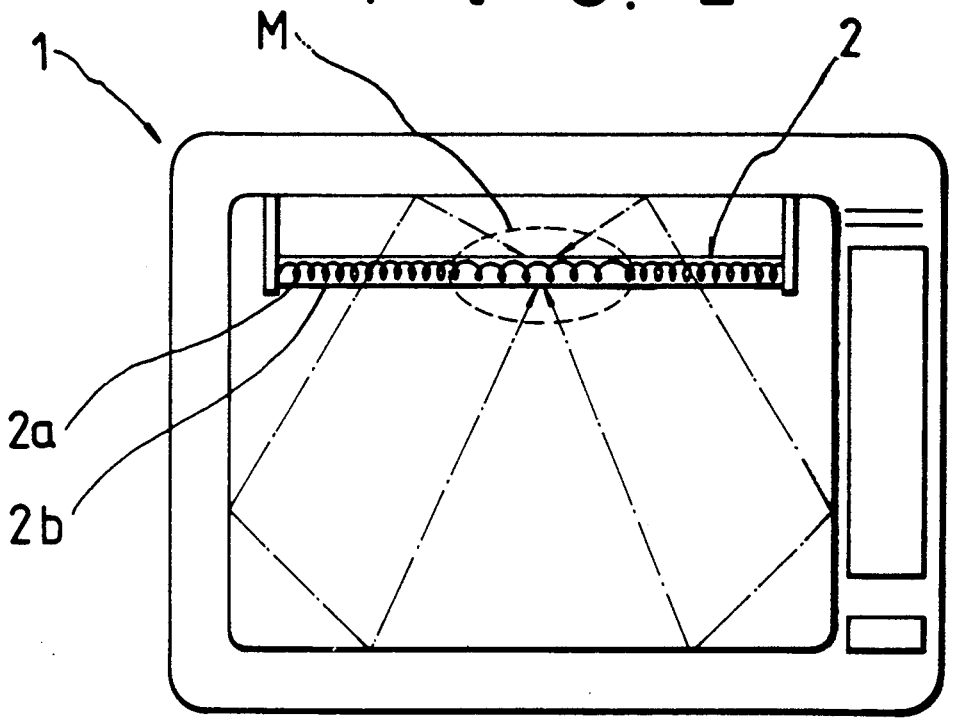
FIG. 2 is a schematic cross-sectional view of a microwave oven showing the preferred embodiment of the present invention.

As illustrated in FIG. 1, an infrared rays heating unit 2 according to the present invention is comprised of; a heating coil 2*a* located in an infrared rays heating lamp envelope 2*b* which is formed of a non-conductor (i.e., electrically insulative) substance. Each end of the lamp envelope 2*b* is sealed by a ceramic insulator 3, and each end of the heating coil 2*a* is joined to an outer lead rod 4 which is made of stainless steel and becomes connected to the electric power source.

Figure 3:
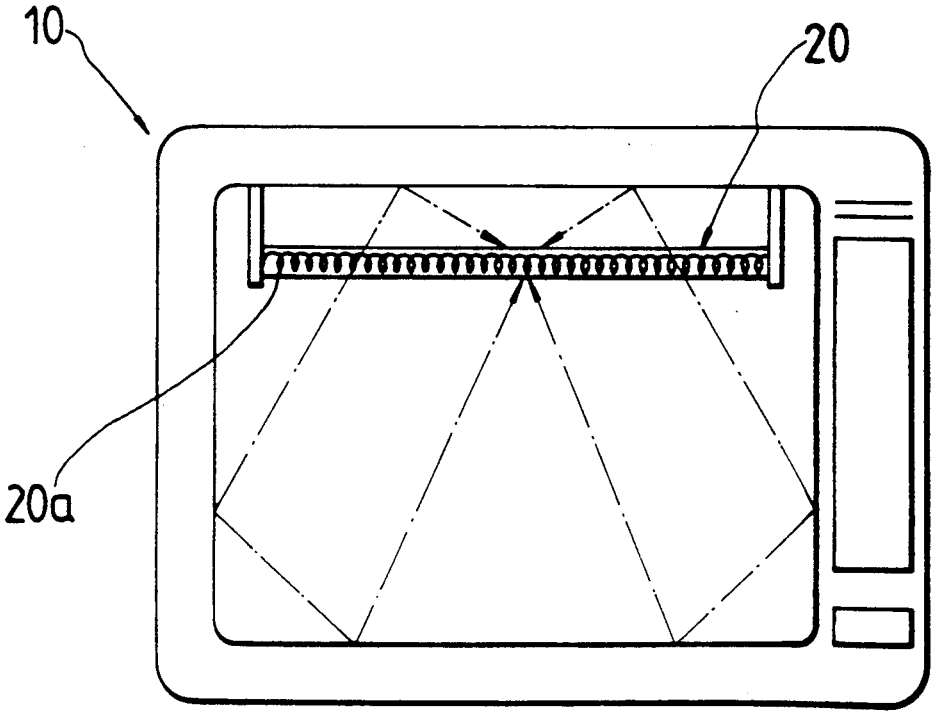
FIG. 3 (PRIOR ART)
FIG. 3 is a schematic cross-sectional view of a microwave oven showing a conventional heating coil.

As illustrated in FIG. 3, the pitch interval of a conventional heating coil 20*a* is generally formed in a regular and dense pattern. Thus, the middle part of the heating coil 20*a* becomes easily broken by the concentration of radiant heat on the middle section when the radiant heat is reflected, by both the walls of the microwave oven and foodstuffs therein, back to the infrared rays heating unit 20.

The heating coil 2*a* according to the present invention devised to solve the above problem is divided into a loosely wound section located at the middle section "M" of the heating coil 2*a* and a tightly wound section located at both ends of the heating coil 2*a*.

Therefore, the number of loops in the heating coil 2*a* in the middle section "M" of the heating coil 2*a* is less than that at either end section, so that the intensity of the infrared rays radiated by the middle section "M" is substantially lower than that of the infrared rays radiated by either end section. That is, the heating value for the unit length generated at the middle part "M" of the heating coil 2*a* is less than that generated at either end section.

Consequently, thermal equilibrium over the entire length of the heating coil 2*a* is accomplished and the heating coil 2*a* is better able to withstand the radiant heat that is reflected by the walls of the microwave oven and the foodstuffs therein.

In order to radiate a fixed quantity of the infrared rays required in a certain sized microwave oven, namely, in order to supply the power required in the infrared rays heating unit to serve the intended purpose of the microwave oven, a heating coil with a fixed length is necessary.

In order to provide 700 Watts of power that is required for the operation of the microwave oven, according to the present invention the heating coil 2*a* consists of a middle section "M" having a length of about 74 MM and each end section having a length of about 120 MM respectively, providing an entire length of about 314 MM.

Accordingly, the ratio of the length of the middle section "M" to both end sections of the heating coil 2a is approximately 0.23 to 0.77.

It is noted that the length and the pitch interval of the loops in the heating coil 2a may vary in accordance with the size of the accompanying microwave oven.

The pitch interval of the loops at the end sections is in the range of approximately 1.252–1.372 MM(0.049–0.054 INCH) like that of the conventional arts; however, the pitch interval of the middle section "M" of the heating coil 2a is in the range of approximately 1.477–1.648 MM(0.058–0.064INCH).

The present invention, accordingly, is a new and useful invention which extends the service life of the heating coil 2a and thus the product costs and maintenance expenses are lower, compared with the conventional inventions.

The above descriptions are also proven by actual tests of the heating coil with respect to the present invention and the conventional ones.

That is, the results of actual tests in which the heating coils were subjected to 120 percent of the regular voltage at regular time intervals of twenty minutes "on" and ten minutes "off" indicate that the conventional heating coils became broken after twenty-two "on-off" cycles, whereas the heating coils according to the present invention continued working even after five hundred "on-off" cycles.

What is claimed is:

1. A microwave oven comprising a cooking compartment having side walls, a floor, and a ceiling, and an infrared heating unit mounted on said ceiling, said infrared heating unit comprising a lamp envelope of electrically insulative material having two opposite ends, an electrical lead disposed at each of said ends, and a heating coil disposed within said lamp and having two ends connected to respective ones of said leads, said coil including a series of coil loops extending along a length of said coil, said series of loops including two end groups of loops located at respective end sections of said coil, and an intermediate group of loops located between said end groups of loops, wherein radiant heat reflected off said side walls, floor, and ceiling tends to be concentrated at said intermediate group of loops, said loops of said intermediate group having a larger pitch interval than the loops of either of said end groups.

2. A microwave oven according to claim 1, wherein said intermediate group of loops is located centrally of said end groups.

3. A microwave oven according to claim 1, wherein a ratio of a length of said middle group to combined lengths of said ends groups is approximately 0.23 to 0.77.

4. A microwave oven according to claim 3, wherein said pitch interval of said middle group is in the range of approximately 1.252–1.372 mm, and said pitch interval of each of said end groups is in the range of approximately 1.477–1.648 mm.

5. A microwave oven according to claim 1, wherein said pitch interval of said middle group is in the range of approximately 1.252–1.372 mm, and said pitch interval of each of said end groups is in the range of approximately 1.477–1.648 mm.

6. A microwave oven according to claim 1 including ceramic sealing members mounted at respective ends of said lamp envelope, said leads extending through respective ones of said sealing members and formed of stainless steel.

* * * * *